US008800420B2

(12) United States Patent
Simione

(10) Patent No.: US 8,800,420 B2
(45) Date of Patent: Aug. 12, 2014

(54) AMMUNITION POUCH WITH DISPENSOR

(71) Applicant: Bulldog Equipment, LLC., Hollywood, FL (US)

(72) Inventor: Jason Simione, Stuart, FL (US)

(73) Assignee: Bulldog Equipment, LLC., Hollywood, FL (US)

( * ) Notice: Subject to any disclaimer, the term of this patent is extended or adjusted under 35 U.S.C. 154(b) by 0 days.

(21) Appl. No.: 13/908,296

(22) Filed: Jun. 3, 2013

(65) Prior Publication Data

US 2013/0319213 A1 Dec. 5, 2013

Related U.S. Application Data

(60) Provisional application No. 61/654,372, filed on Jun. 1, 2012.

(51) Int. Cl.
*F42B 39/26* (2006.01)

(52) U.S. Cl.
CPC ..... *F42B 39/26* (2013.01)
USPC ..... 89/34; 206/3

(58) Field of Classification Search
USPC ..... 89/34, 33.14, 33.2; 206/3; 86/48
See application file for complete search history.

(56) References Cited

U.S. PATENT DOCUMENTS

| | | | | | |
|---|---|---|---|---|---|
| 661,201 | A | * | 11/1900 | Wilding | 89/34 |
| 1,213,755 | A | * | 1/1917 | Davies | 217/57 |
| 1,719,147 | A | * | 7/1929 | Tansley | 89/33.14 |
| 2,486,949 | A | * | 11/1949 | Hutchison | 206/3 |
| 2,706,575 | A | * | 4/1955 | Soherr | 220/560.1 |
| 6,439,098 | B1 | * | 8/2002 | Dillon | 89/34 |
| 6,799,500 | B1 | | 10/2004 | Kulikowski | |

* cited by examiner

*Primary Examiner* — Reginald Tillman, Jr.
(74) *Attorney, Agent, or Firm* — Fleit Gibbons Gutman Bongini & Bianco PL; Jon A. Gibbons

(57) ABSTRACT

A novel ammunition pouch formed from material cut to form a rectangular container defining an interior opening sized to store ammunition disposed on a belt. The container includes a bottom side, a front side, a back side, a first end and a second end, and a top flap. A feed clip disposed on the first end, the feed clip including a feed clip opening in communication with the interior compartment, the feed clip opening sized to accommodate the ammunition disposed on a belt, including an upper spring bracket and lower spring bracket attached around the feed clip opening and positioned to provide a slip-fit for the ammunition disposed on the belt to passthru. A strap with a first end mechanically coupled with the feed clip, and second end with at least one of a clip and a Velcro-compatible fastener for removably coupling with the second end of ammunition pouch.

18 Claims, 5 Drawing Sheets

AMMUNITION POUCH WITH DISPENSOR

CROSS-REFERENCE TO RELATED APPLICATIONS

This application is a continuation-in-part of and claims priority from prior U.S. Provisional Patent Application No. 61/654,372, filed on Jun. 1, 2012, the entire disclosure of which application is incorporated by reference in its entirety.

FIELD OF THE INVENTION

The present invention generally relates to ammunition holders, and more particularly a pouch for dispensing rounds of ammunition to machine guns.

BACKGROUND OF THE INVENTION

The machine gun is a principal weapon in any modern arsenal. Like any other weapon, the employment and use of the machine gun is restrained by cost, time, and utility. Such restrains also apply to machine gun ammunition, which is needed in great quantities to support any military operation. Consequently, machine gun ammunition must be able to be deployed and handled rapidly.

In combat, machine gun ammunition is put into ammunition boxes, and is often put on belts to function with the self-loading mechanism of most machine guns. The ammunition package or container must also be designed so that it does not interfere with other military objectives. For example, it must require little maintenance.

SUMMARY OF THE INVENTION

Disclosed is a novel ammunition pouch formed from material cut to form a rectangular container defining an interior opening sized to store ammunition disposed on a belt. The container includes a bottom side, a front side, a back side, a first end and a second end, and a top flap. A feed clip disposed on the first end, the feed clip including a feed clip opening in communication with the interior compartment, the feed clip opening sized to accommodate the ammunition disposed on a belt, including an upper spring bracket and lower spring bracket attached around the feed clip opening and positioned to provide a slip-fit for the ammunition disposed on the belt to passthru. A strap with a first end mechanically coupled with the feed clip, and second end with at least one of a clip and a Velcro-compatible fastener for removably coupling with the second end of ammunition pouch. A corresponding clip and a Velcro-compatible fastener is mechanically coupled to the second end of the ammunition pouch.

In one example, a plurality of straps are attached to the bottom side in a pattern compatible with Modular Lightweight Load-carrying Equipment (MOLLE) system. A fabric handle may be mechanically attached to the top flap as well.

DETAILED DESCRIPTION

Figure 1:
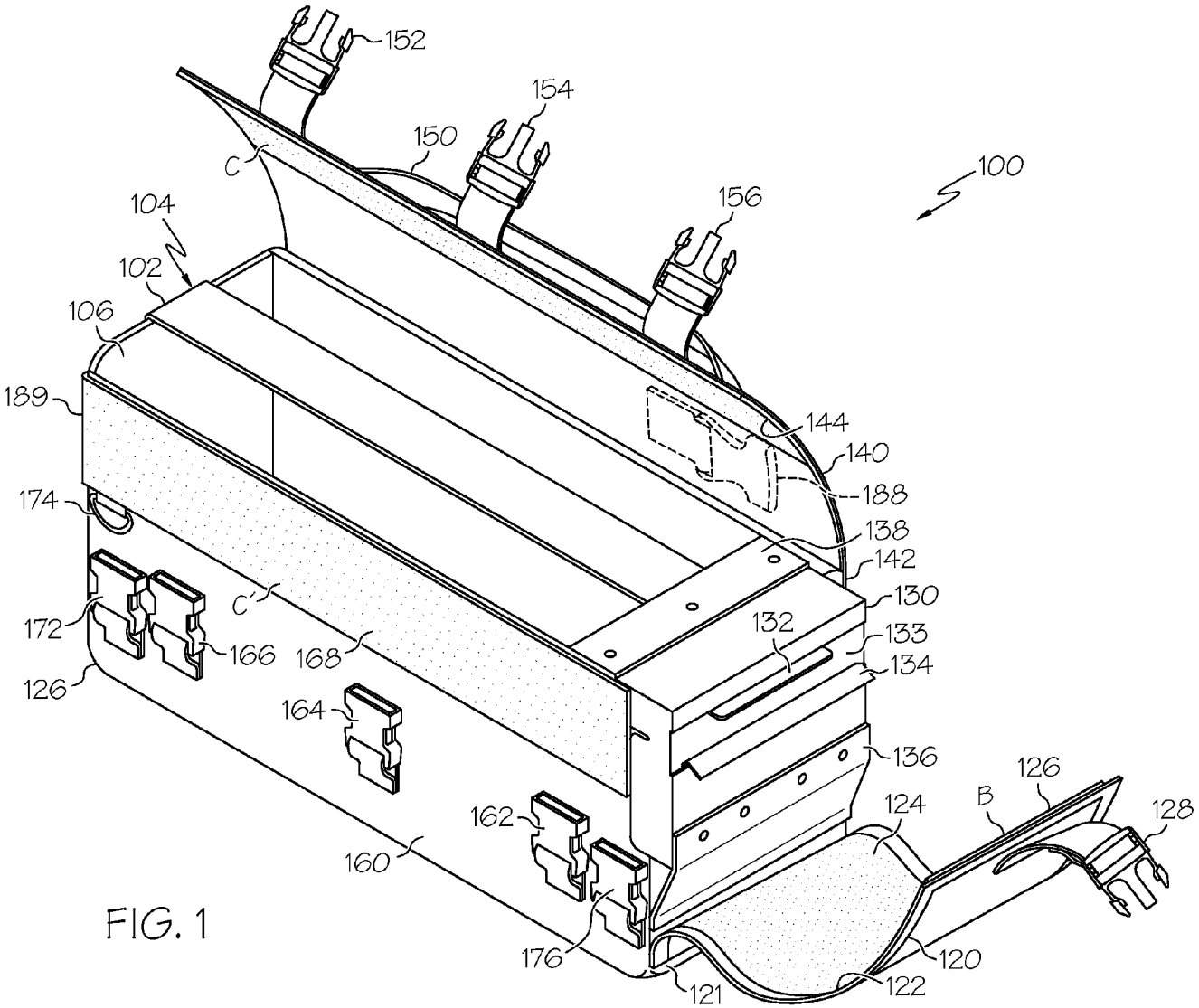
FIG. 1 is a perspective view showing an ammunition pouch with a feed clip showing a top flap and front flap opened.

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

Disclosed is an innovative rectangular-shaped pouch, container, or enclosure with a woven fabric and a clip feed made of a rigid material, such as metal, composite, molded plastic, or combination thereof. The fabric is any commercially available military type that is wear and rot resistant, and preferably made of a ballistic material such as KEVLAR® material. The fabric pieces (sides) are attached by conventional methods used for fabricating bags and containers for military use, such as by sewing and/or gluing. The sides made of material along with the clip feed are rigid enough to provide structural support for the pouch. The fabric used for the top flap, front side, the back side, the bottom side, the first end, and the second end, and the webbing may be the same fabric or different types of fabric.

The innovative ammunition pouch with dispenser are MOLLE (Modular Light weight Load carrying Equipment) compatible and can be adapted to various pack frames including ALICE (All-Purpose Lightweight Individual Carrying Equipment). The innovative ammunition pouch with dispenser are lighter than current issue items and offer improved accessibility and greater security regarding the tripod retention. Additionally, ammunition is readily accessible allowing for rapid reloading of the weapon system it supports. A single layer of webbing combined with the removal of the plastic stiffener and the permanent mounting of a stamped metal one inch Tri Glide from ITW Nexus. This allows for the webbing to be locked in place preventing accessory movement. The ammunition pouches are designed around the dimensions of the 100 Round Card Board Ammo Box that the 7.62 ammo is supplied in. This dispenser and bracket provides enough tension on the rounds to prevent rounds from falling from the pouch onto the ground regardless of its position, even if inverted. The tension however does not interfere with the feeding of rounds into the weapon. This ammunition pouch allows the ammunition to be rapidly accessed and linked to the ammunition. It takes more than 20 seconds to link the ammunition together using current issue ammo bags. The ammunition pouch allows for expedited and efficient ammunition access.

Figure 2:
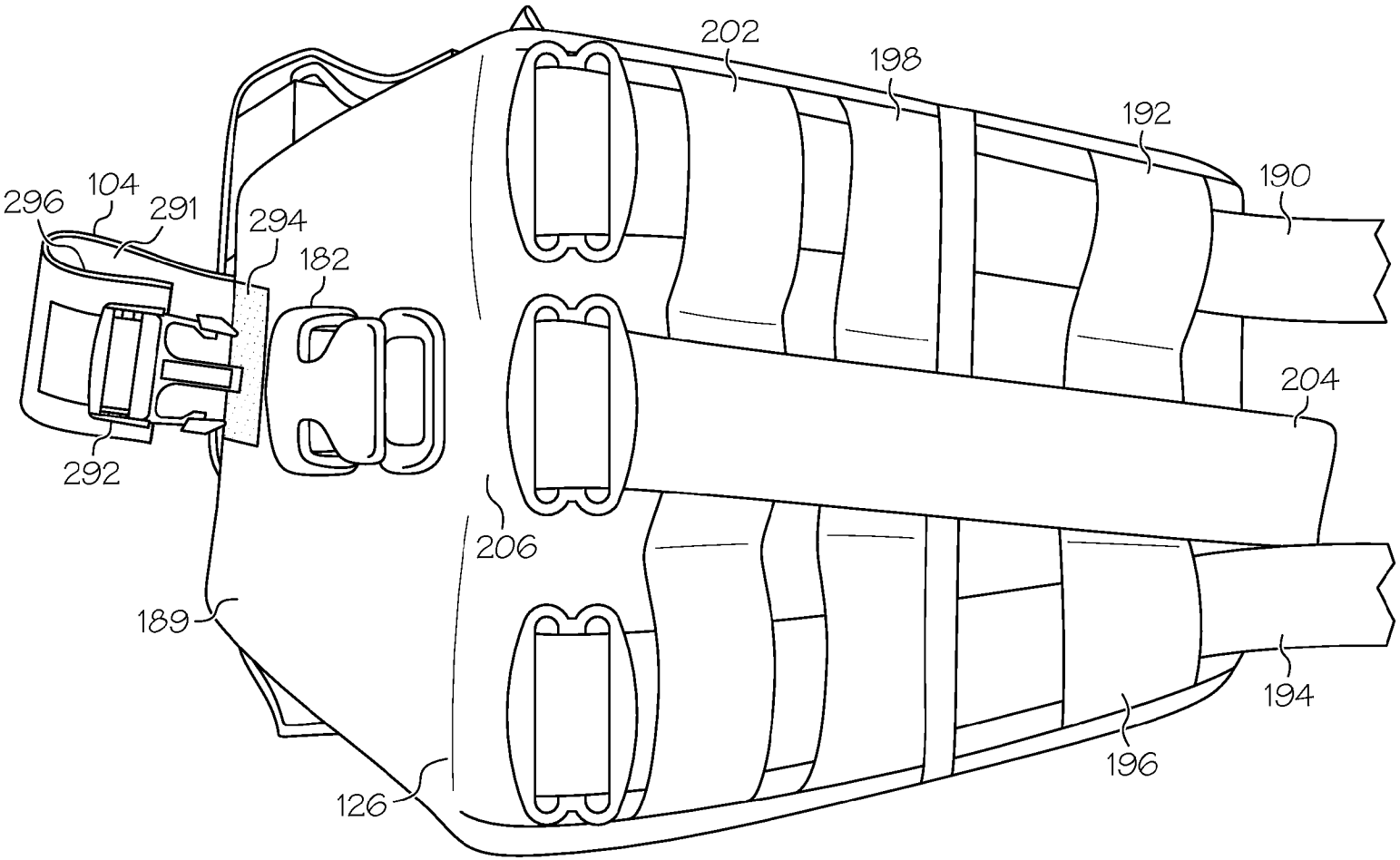
FIG. 2 is bottom perspective view of the pouch of FIG. 1.

FIG. 1 is a perspective view showing an ammunition pouch 100 with a feed clip 130 showing a top flap 140 and the first end flap 120 opened. In one example the majority of the ammunition pouch can be cut as a single piece of material that has been cut. The sides of the single piece of material are joined by sewing, gluing, riveting, or a combination thereof for assembly. In another embodiment, separate pieces of materials are used. The ammunition pouch 100 is substantially rectangular in shape with the side feed clip 130 disposed along a first end 136 of the rectangle ammunition pouch 100. The top flap 140 is coupled to back side 142 along a long edge or just one edge of the rectangle to form a movable joint or hinge. In one example the top flap 140 is a separate piece of material from the back side. In other example, it is one continuous piece of material. This allows the top flap 140 to swing from a closed position to the open position. The top flap 140 mates with front side 160 through a combination of mateable Velcro-compatible surfaces and latches. Velco® is a fastener consisting of two strips of thin plastic sheet, one covered with tiny loops (female gender) and the other with tiny flexible hooks (male gender). Although the term Velcro-compatible is used to describe fasteners in this patent application, there are other providers of Velcro-compatible fasteners that operate the same and the present disclosure is not limited to only Velcro-compatible fasteners. Specifically, the inner surface or the underside 144 of the top flap 140 includes Velcro-compatible of a first type, such as male, to couple with Velcro-compatible of a second type, such as female, disposed the outer surface 168 of front side 160 as shown. The top flap 140 covers an interior compartment 106. A top portion of the interior compartment 106 includes an opening sized to receive ammunitions disposed on a belt. A stabilizing web or strap 104 is firmly attached at a first end to the feed clip 132. Shown in FIG. 2 is the second end of the strap 104 includes a latch (male) 292 to coupled latch 182 on a second end 190. The purpose of this strap 104 is to provide rigidly to the ammunition pouch 100 in response to ammunition being bulled through the opening 133 of feed clip 132. Latches (male) 152, 154, 156 are mechanically coupled to top flap 140. Corresponding latches (female) 162, 164, 166 are mechanically coupled to the side 160. The combination of male and female latches or corresponding Velcro-compatible, provides removable coupling. Additional Latches (female) 172 and 176 are included to permit coupling with other bags or straps or supplies.

A top end 126 of the first end flap 120 mates over and on top of the top flap 140 through a combination of mateable Velcro-compatible surfaces and latches. Specifically, a portion the top surface (not shown) on top flap 140 includes Velcro-compatible of a first type, such as female, to couple with Velcro-compatible of a second type, such as male, disposed a section 124 of an underside 122 on the first end flap 120. Corresponding latches (male) 128 are mechanically coupled to a latch (female) 188 coupled to top flap 140. When the top flap 140 is mechanically coupled to the side 160, this provides cover to the feed clip 130. A bottom end 121 of the first end flap 120 is mechanically fastened to the bottom side 206 of FIG. 2.

Also shown is a D-ring 174 mechanically coupled to side 160. This is used as an attachment point for a snap clip. A handle 150 attached to the top flap 140 is made from webbing or fabric is shown.

A feed clip 130 with an upper spring 132 and lower spring bracket 134 is shown. The components can be made of plastic, metal, composite or a combination thereof. A feed clip opening 133 between the upper spring bracket 132 and lower spring bracket 134 is sized to accommodate ammunitions on belt. It is important to note that the feed clip opening can be sized to accommodate a wide variety of ammunitions on a belt, such as 5.56 mm caliper bullets suitable for M16A1, M16A2, M4A1, M16A4 rifles. The feed clip opening is in communication the interior compartment and is further described with reference to FIGS. 3-4 below.

Turning now to FIG. 2, shown is bottom perspective view of the pouch of FIG. 1. Shown is a female clip 182 to couple with male clip 292 of strap 104. A Velcro-compatible portion 294 and corresponding Velcro-compatible portion 296 on underside 291 of strap 104. Webbing 192, 198, 202 is fastened near substantially parallel to the rear edge 126 of back side 189 as shown. Straps 190 and 194 are coupled to the bottom side 206 and pass underneath areas of the webbing 192, 198, and 202, as shown. The can be attached to a pack or belt or MOLLE system. In one example, the straps 190 and 194 and the webbing 192, 198, and 202 forms a pattern compatible with Modular Lightweight Load-carrying Equipment (MOLLE) system. One such pattern is a Pouch Attachment Ladder System or PALS, used to attach smaller equipment onto load-bearing platforms, such as vests and backpacks.

Figure 3:
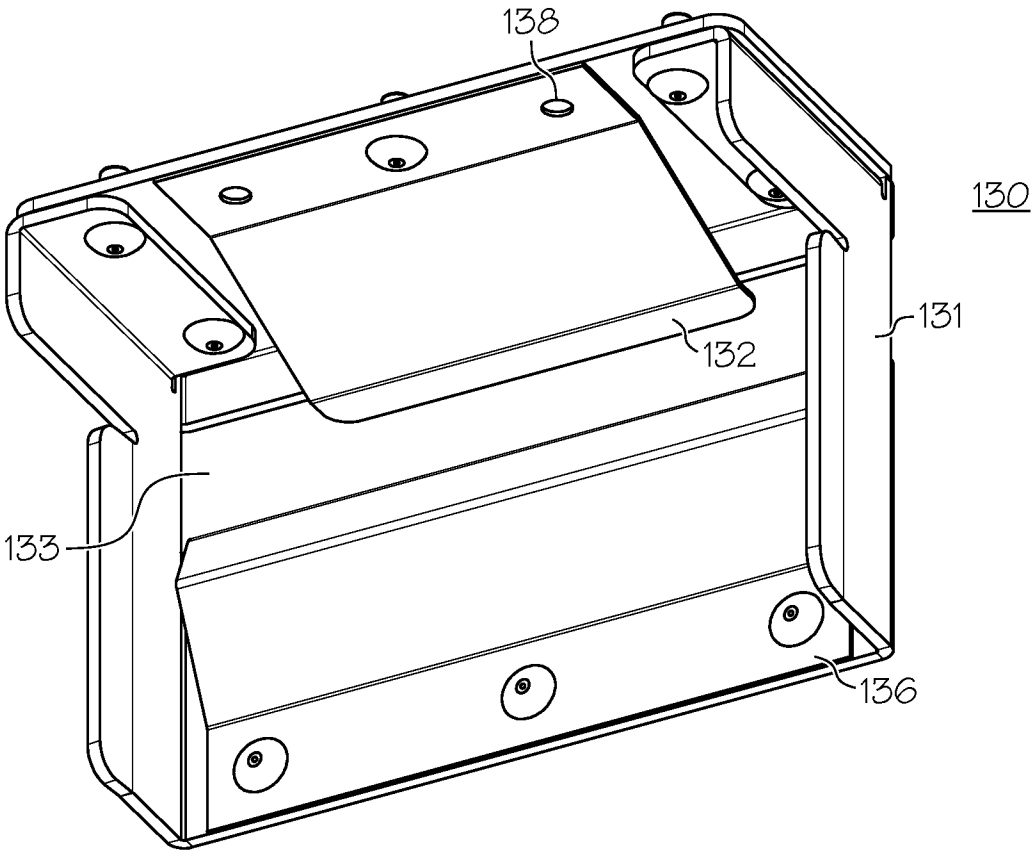
FIG. 3 is a front perspective view of the feed clip of FIG. 1 and FIG. 2.
Figure 4:
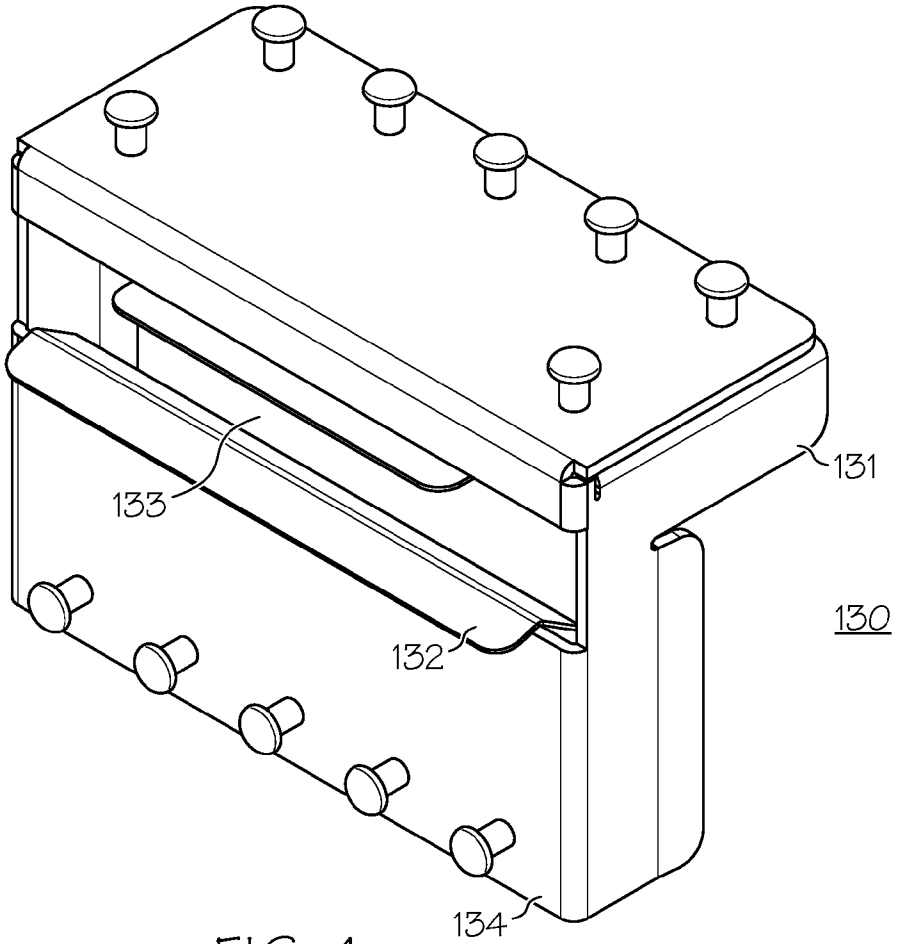
FIG. 4 is a side perspective view of the feed clip of FIG. 3.

FIG. 3 is a front perspective view of the feed clip 130 of FIG. 1 and FIG. 2. The feed clip in one example is formed from three distinct components a frame 131 with an opening 133, an upper spring 132 and a bottom spring 134 fastened to the frame 131 through rivets, screws, welds, glues, or a combination thereof. FIG. 4 is a side perspective view of the feed clip of FIG. 3. A set of side mushroom shaped rivets 184 with side external plate or cover 184 is shown. Also shown is set of top mushroom shaped rivets 188 with top external plate or cover 186. The side external cover 184 and top external cover 186 are disposed on the outside of the material forming the ammunition pouch 100. The feed clip opening 133 is sized to accommodate the ammunition disposed on a belt, including an upper spring bracket and lower spring bracket attached around the feed clip opening and positioned to provide a slip-fit for the ammunition disposed on the belt to passthru.

Figure 5:
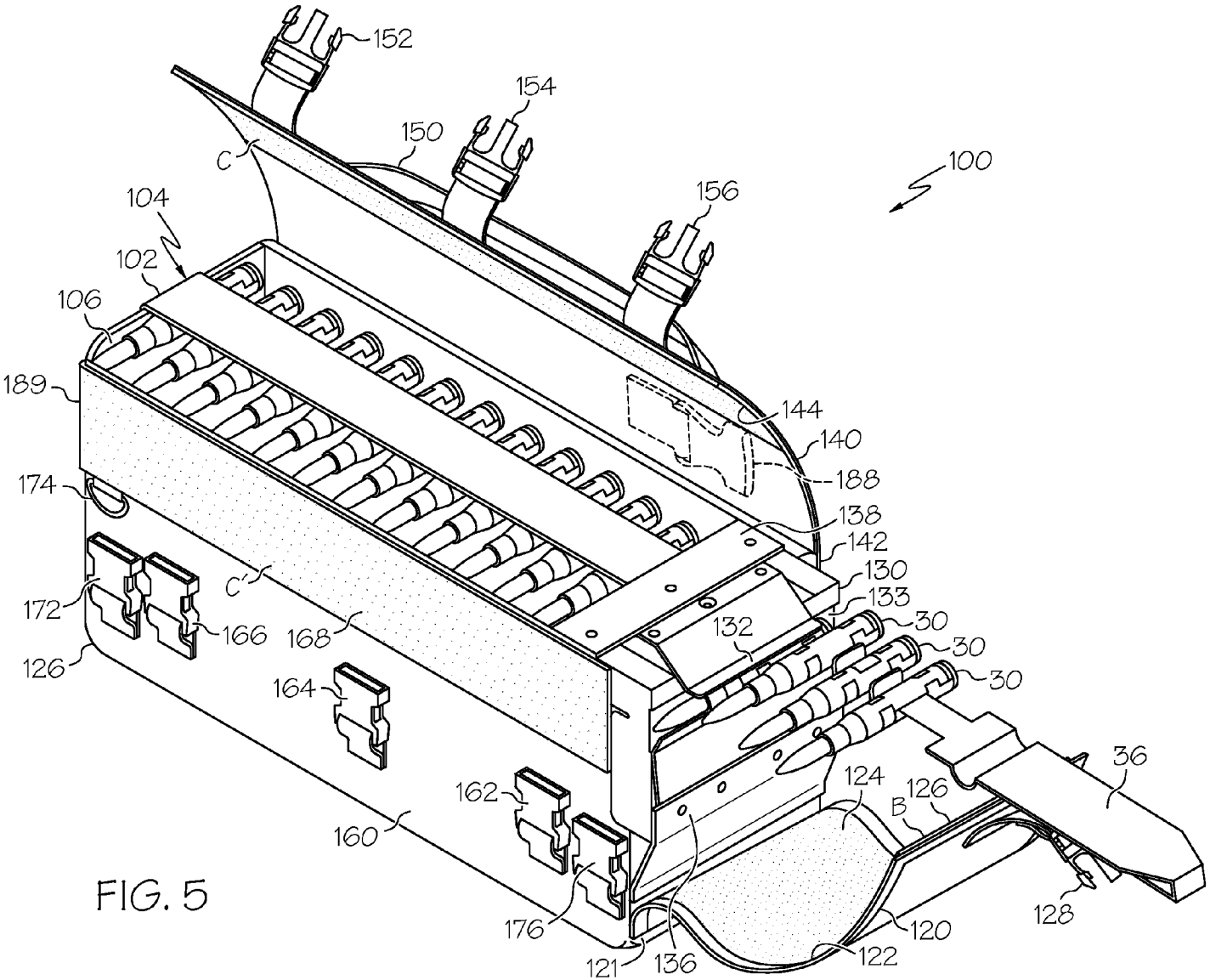
FIG. 5 is a perspective view of the ammunition pouch of FIG. 1 showing belted ammunition.

FIG. 5 is a perspective view of the ammunition pouch of FIG. 1 with ammunition 30 on belt 36 through opening 133 of feed clip 130.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A pouch for holding belted machine gun ammunition, the pouch comprising:

a substantially rectangular container defining an interior compartment formed by a bottom side, a front side, a back side, a first end and a second end, and the front side includes at least a portion of an outer surface covered by a Velcro-compatible fastener and a top portion of the interior compartment includes an opening for receiving ammunitions disposed on a belt into the interior compartment;

a top flap mechanically coupled along one edge to the back side and the top flap sized to cover the top portion and at least a portion of an inner surface covered by a Velcro-compatible fastener to removably couple with the Velcro-compatible fastener on the front side;

a feed clip disposed on the first end, the feed clip including a feed clip opening in communication with the interior compartment, the feed clip opening sized to accommodate the ammunition disposed on a belt, including an upper spring bracket and lower spring bracket attached around the feed clip opening and positioned to provide a slip-fit for the ammunition disposed on the belt to passthru; and a strap with a first end mechanically coupled with the feed clip, and second end with at least one of a clip and a Velcro-compatible fastener for removably coupling with the second end of the substantially rectangular container.

2. The pouch of claim 1, further comprising at least one of a clip and a Velcro-compatible fastener mechanically coupled to the second end of the rectangular container to removably couple with the second end of the strap.

3. The pouch of claim 1, further comprising a first end flap with a top end and bottom end, an inner surface and outer surface, the inner surface including at least a portion of covered by a Velcro-compatible fastener and the top flap including a top surface with at least a portion covered by Velcro-compatible fastener for mating with the Velcro-compatible fastener on the inner surface of the first end flap.

4. The pouch of claim 1, wherein the front side includes two or more fasteners of a first gender attached thereto and the top flap includes two or more fasteners of a second gender attached thereto for mechanically coupling with the fasteners of the first gender on the front side.

5. The pouch of claim 1, wherein the feed clip is formed from a material including at least one of metals, plastics, composites, or a combination thereof.

6. The pouch of claim 1, further comprising:

a plurality of straps attached to the bottom side in a pattern compatible with Modular Lightweight Load-carrying Equipment (MOLLE) system.

7. The pouch of claim 1, wherein at least one of the bottom side, the top flap, the front side, the back side, the first end and the second end are formed from a KEVLAR® material.

8. The pouch of claim 7, wherein the feed clip is mechanically joined to the front side using a plate with rivets therethrough.

9. The pouch of claim 8, further comprising:

a fabric handle mechanically attached to the top flap.

10. An ammunition pouch, comprising:

a single piece of material cut to form a rectangular container defining an interior compartment sized to store ammunition disposed on a belt, the container including a bottom side, a front side, a back side, a first end and a second end, and a top flap;

a feed clip disposed on the first end, the feed clip including a feed clip opening in communication with the interior compartment, the feed clip opening sized to accommodate the ammunition disposed on a belt, including an upper spring bracket and lower spring bracket attached around the feed clip opening and positioned to provide a slip-fit for the ammunition disposed on the belt to passthru; and a strap with a first end mechanically coupled with the feed clip, and second end with at least one of a clip and a Velcro-compatible fastener for removably coupling with the second end of the rectangular container.

11. The ammunition pouch of claim 10, further comprising at least one of a clip and a Velcro-compatible fastener mechanically coupled to the second end of the rectangular container to removably couple with the second end of the strap.

12. The ammunition pouch of claim 10, further comprising a first end flap with a top end and bottom end, an inner surface and outer surface, the inner surface including at least a portion of covered by a Velcro-compatible fastener and the top flap including a top surface with at least a portion covered by Velcro-compatible fastener for mating with the Velcro-compatible fastener on the inner surface of the first end flap.

13. The ammunition pouch of claim 10, wherein the front side includes two or more fasteners of a first gender attached thereto and the top flap includes two or more fasteners of a second gender attached thereto for mechanically coupling with the fasteners of the first gender on the front side.

14. The ammunition pouch of claim 10, wherein the feed clip is formed from a material including at least one of metals, plastics, composites, or a combination thereof.

15. The ammunition pouch of claim 10, further comprising:

a plurality of straps attached to the bottom side in a pattern compatible with Modular Lightweight Load-carrying Equipment (MOLLE) system.

16. The ammunition pouch of claim 10, wherein at least one of the bottom side, the top flap, the front side, the back side, the first end and the second end are formed from a KEVLAR® material.

17. The ammunition pouch of claim 16 wherein the feed clip is mechanically joined to the front side using a plate with rivets therethrough.

18. The ammunition pouch of claim 17, further comprising:

a fabric handle mechanically attached to the top flap.

* * * * *